US011602198B2

(12) United States Patent
Fyfe et al.

(10) Patent No.: US 11,602,198 B2
(45) Date of Patent: Mar. 14, 2023

(54) CABLE LOCK WITH COMPLIANT CABLE ENGAGEMENT FEATURE

(71) Applicant: NIKE, Inc., Beaverton, OR (US)

(72) Inventors: Althea R. Fyfe, Portland, OR (US); Doug D. Wilken, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/243,678

(22) Filed: Apr. 29, 2021

(65) Prior Publication Data

US 2021/0337932 A1 Nov. 4, 2021

Related U.S. Application Data

(60) Provisional application No. 63/017,412, filed on Apr. 29, 2020.

(51) Int. Cl.
*A43C 7/08* (2006.01)
*A43C 11/00* (2006.01)

(52) U.S. Cl.
CPC ..... *A43C 7/08* (2013.01); *A43C 11/008* (2013.01)

(58) Field of Classification Search
CPC .... A43C 7/08; A43C 7/00; A43C 7/04; A43C 11/008; Y10T 24/3724; D07B 1/00; D07B 1/162; F16G 9/04
See application file for complete search history.

(56) References Cited

U.S. PATENT DOCUMENTS

| | | | | |
|---|---|---|---|---|
| 4,644,610 | A * | 2/1987 | Fish | F16L 3/223 24/30.5 S |
| 6,513,210 | B1 * | 2/2003 | Gonzalez | D04C 1/02 24/712 |
| 7,549,201 | B2 * | 6/2009 | Kraft | A43C 9/00 24/713 |
| 10,548,372 | B2 * | 2/2020 | Chamberlain | A43C 1/00 |
| 11,000,096 | B2 * | 5/2021 | Hamilton | A43C 7/00 |
| 2005/0183245 | A1 * | 8/2005 | Whipple | B65D 63/14 24/129 R |
| 2009/0223085 | A1 | 9/2009 | Wolfberg | |
| 2010/0175732 | A1 * | 7/2010 | Ma | F16G 11/103 135/161 |
| 2011/0132418 | A1 * | 6/2011 | Ma | F16G 11/105 135/37 |

(Continued)

FOREIGN PATENT DOCUMENTS

FR 2905238 A1 3/2008

*Primary Examiner* — Robert Sandy
*Assistant Examiner* — Louis A Mercado
(74) *Attorney, Agent, or Firm* — Quinn IP Law

(57) ABSTRACT

A cable lock adapted to temporarily maintain a static position along a cable strung through an article of footwear or apparel includes a housing and a compliant insert. The housing defines an aperture and is formed from a first material. The aperture extends through a thickness of the housing to provide access to the cable. The insert is provided at least partially within the aperture and defining an opening, the insert formed from a second material that is softer than the first material, the insert includes a plurality of cable engaging features extending radially inward from a perimeter of the aperture, the plurality of cable engaging features being adapted to deflect away from a neutral, unstressed plane when a cable is drawn through the opening.

20 Claims, 6 Drawing Sheets

(56) References Cited

U.S. PATENT DOCUMENTS

| | | | | |
|---|---|---|---|---|
| 2015/0007423 | A1* | 1/2015 | Yang | A43C 7/00 24/713 |
| 2015/0173459 | A1* | 6/2015 | Yang | A43C 7/00 24/713.2 |
| 2016/0029745 | A1* | 2/2016 | Atherinos | F16B 2/22 24/712.1 |
| 2016/0286899 | A1* | 10/2016 | Chamberlain | A43C 7/00 |
| 2018/0062318 | A1 | 3/2018 | Sze | |

* cited by examiner

CABLE LOCK WITH COMPLIANT CABLE ENGAGEMENT FEATURE

CROSS REFERENCE TO RELATED APPLICATIONS

The present application claims the benefit of priority from U.S. Provisional Patent Application No. 63/017,412, filed Apr. 29, 2020, which is incorporated by reference in its entirety.

TECHNICAL FIELD

The present disclosure generally relates to a cable-lock device that is selectively slidable along the length of a cable, such as for securing the ends of a shoelace or apparel drawstring.

BACKGROUND

Drawstrings, elastic bands, and laces (collectively "cables") are commonly used in articles of apparel, articles of footwear, bags, and other such products to provide a measure of adjustability in the fit, length, or diameter of the product. For example, articles of footwear conventionally have laces that may adjust the size of an upper around the wearer's foot. A jacket may include a drawstring extending through the wrist cuff or in a lower seam around the wearer's waist. A bag may include a cable or drawstring extending through a hemmed end near the opening. Tensioning any of these cables relative to their adjoining article may then cause a drawing in of material which may dimensionally constrict the article.

Conventionally, knots or bows can be used to tie off the cable to prevent the adjoining article/material from relaxing to its untensioned state. Likewise, toggle-type momentary clamps or other temporary clamps have been developed to serve as a more readily adjustable affixing means than a knot. Such designs, however, often include multi-piece spring-loaded clamps that require a certain degree of dexterity and finger strength to open.

SUMMARY

In general, the present disclosure relates to a cable lock that may be used to secure opposing ends of a cable. This cable lock may find particular utility with cables used in connection with articles of footwear or apparel. For example, this lock may be used to secure opposing end portions shoelaces, waistband drawstrings (e.g., for shorts), cuffs (e.g., with a jacket), travel bags, and the like. This design utilizes one or more compliant cable engaging members to engage with the cable. Due to the design, reversing the direction of travel of the cable relative to the lock requires the cable engaging member to toggle over-center, which requires a greater amount of force than would be required with continued translation in the original direction. To provide structure to the design, in many embodiments, the cable lock may include a more rigid housing that includes an aperture to receive the cable, and a comparatively more compliant insert that includes the cable engaging members.

In this manner, in one configuration, a cable lock adapted to temporarily maintain a static position along a cable strung through an article of footwear or apparel includes a housing and a compliant insert. The housing defines an aperture and is formed from a first material. The aperture extends through a thickness of the housing to provide access to the cable. The insert is provided at least partially within the aperture and defining an opening, the insert formed from a second material that is softer than the first material, the insert comprising a plurality of cable engaging features extending radially inward from a perimeter of the aperture, the plurality of cable engaging features being adapted to deflect away from a neutral, unstressed plane when a cable is drawn through the opening.

Likewise, in some embodiments, the housing may define both a first aperture and a second aperture, with each of the first and second apertures extending entirely through a thickness of the housing. A compliant insert may then be formed from a polymeric material that is comparatively softer than the housing and may extend across each of the first aperture and second aperture. The compliant insert defines a first opening extending through the insert that is aligned with the first aperture and further defines a second opening extending through the insert that is aligned with the second aperture. The first opening is adapted to receive the first end portion of the cable, and the second opening is adapted to receive the second end portion of the cable. The compliant insert forms a first plurality of cable engaging features extending radially inward from the first opening such that each cable engaging feature of the first plurality of cable engaging features is operative to contact and impress into the first end portion of the cable. Similarly, the compliant insert also forms a second plurality of cable engaging features extending radially inward into the second opening such that each cable engaging feature of the second plurality of cable engaging features is operative to contact and impress into the second end portion of the cable.

In some embodiments, the first material used to form the housing has a hardness of from about 40 D to about 80 D, measured on the Shore D hardness scale, while the second material used to form the insert has a hardness of from about 40 A to about 80 A, measured on the Shore A hardness scale.

Each of the plurality of cable engaging features may have a radius of curvature that is between about 25% and about 40% of a radius of curvature of the aperture or of a smallest possible circle drawn through a root of each of the plurality of cable engaging features. Further, each of the plurality of cable engaging features may extend from a smallest possible circle drawn through a root of each of the plurality of cable engaging features by a distance that is between about 25% and about 40% of the diameter of the circle.

A cable that may be used with the present lock may have an outer diameter that is greater than a diameter of a circle drawn through each of the plurality of cable engaging features. To provide strength, while still allowing the cable engaging member to impress into the material of the cable, the cable may comprise a core layer and an outer layer that surrounds the core layer, and wherein the core layer is less elastic than the outer layer.

Other features and advantages of the present cable lock system are described in the following disclosure, with reference to the provided figures.

DETAILED DESCRIPTION

The following discussion and accompanying figures disclose a cable lock 10 (also referred to herein as a "slider 10") that incorporates a compliant, cable-engaging feature 12 to selectively restrict the lock 10 from translating along the cable 14. Because the present cable lock 10 is not simply a clamp on the cable 14, it enables greater design flexibility in controlling the static and dynamic (sliding) resistance in both the direction of prior travel and in reversing the direction of prior travel. In doing so, the present lock 10 may provide different amounts of resistance (coefficients of friction) for each of the dynamic sliding resistance, static resistance (i.e., from a standstill) in the direction of prior travel, and static resistance against the direction of prior travel. This level of control may prove beneficial, for example, in a child's shoe, where lower resistance may be desirable when tightening the laces (i.e., so the child can lace their own shoes), while a greater amount of resistance may be desirable to reverse the slider once the laces are fully cinched (i.e., to prevent the shoes from inadvertently becoming untied).

In addition to providing increased control over the function/operation of the lock, the present design also minimizes the total number of components within the lock 10 by utilizing compliant materials instead of spring-loaded clasps. This may ultimately provide a more cost-effective design by minimizing the required amount of assembly in creating the lock 10.

Figure 1:
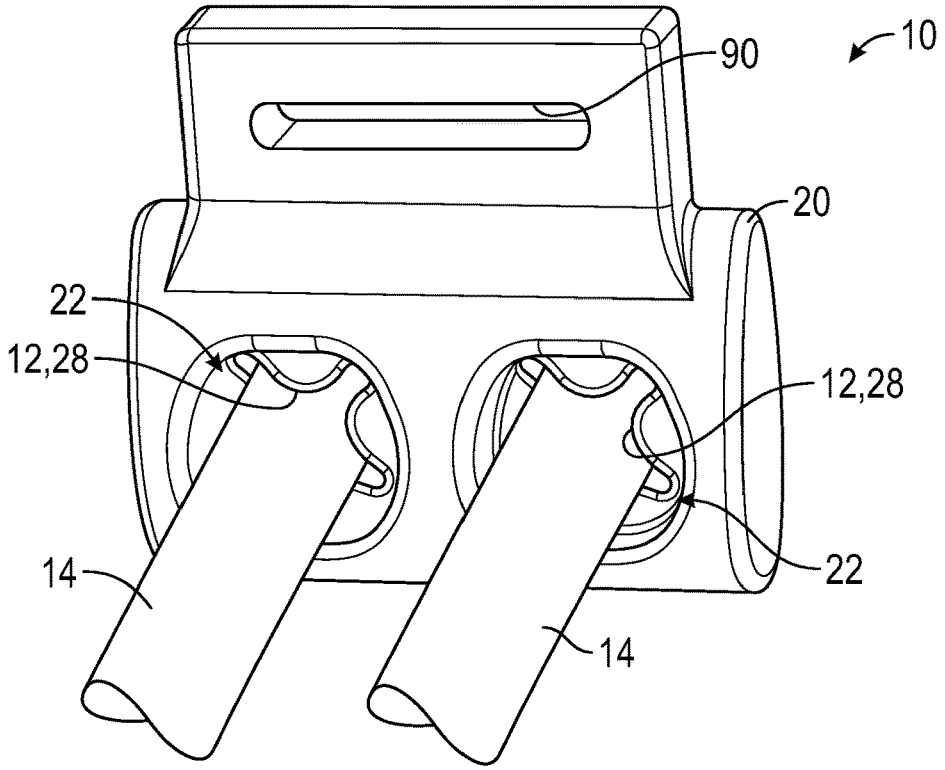
FIG. 1 is a schematic perspective view of an embodiment of a cable lock with cables extending through discrete apertures in the lock
Figure 2:
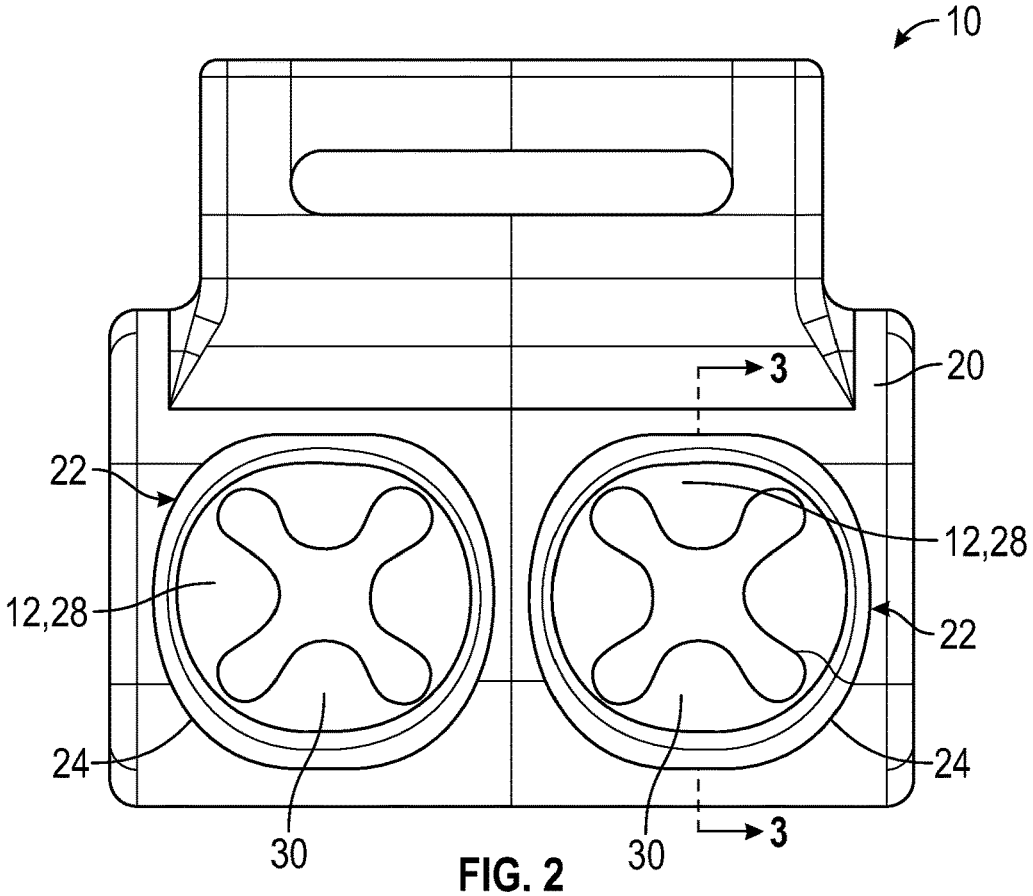
FIG. 2 is a schematic side view of an embodiment of a cable lock.

FIGS. 1-2 schematically illustrate an embodiment of a cable lock 10 and associated cable 14 according to the present disclosure. As generally shown, the lock 10 includes an outer housing 20 that defines one or more apertures 22 extending entirely through a thickness of the housing 20. Each aperture 22 may include one or more compliant, cable-engaging features 12 that protrude inward from an outer perimeter 24 of the aperture 22. To facilitate the locking action of slider 10 on the cable 14, the cable-engaging features 12 may be dimensioned so that they contact and at least partially impinge into the cable 14 when the cable 14 extends through the aperture 22.

With reference to FIG. 1, in one embodiment each aperture 22 may have a circular outer perimeter 24, and the cable-engaging features 12 may comprise a plurality of discrete lobes 28 that are equally spaced around the perimeter 24. While FIG. 1 illustrates four lobes 28, it should be understood such is just an example, and other designs may include more or fewer lobes. For example, in one embodiment, each aperture 22 may include three equally spaced lobes 28, while in other embodiments, each aperture 22 may include five or six or more lobes 28.

Figure 3:
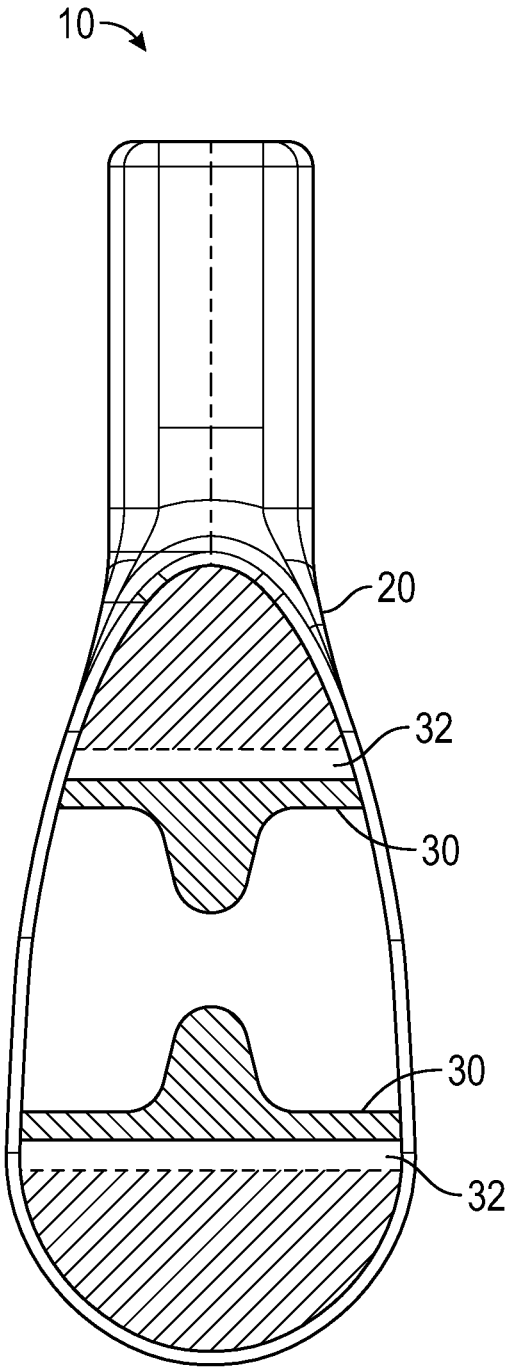
FIG. 3 is a schematic partial cross-sectional view of a cable lock, such as taken along line 3-3 in FIG. 2, formed via a co-molding process.
Figure 4:
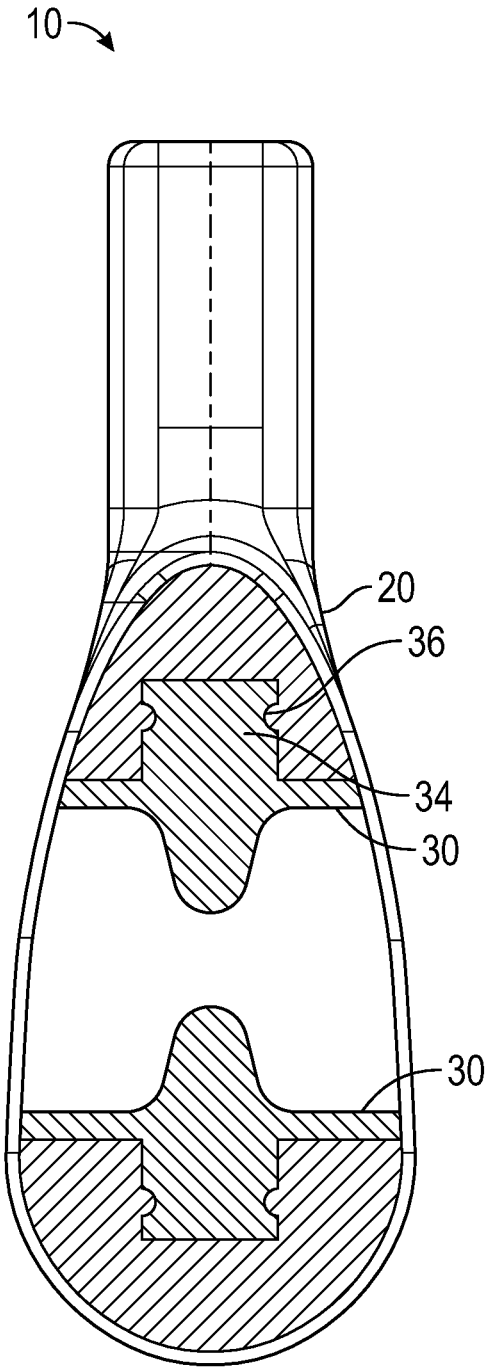
FIG. 4 is a schematic partial cross-sectional view of a cable lock, such as taken along line 3-3 in FIG. 2, formed via an insert injection molding process.
Figure 5:
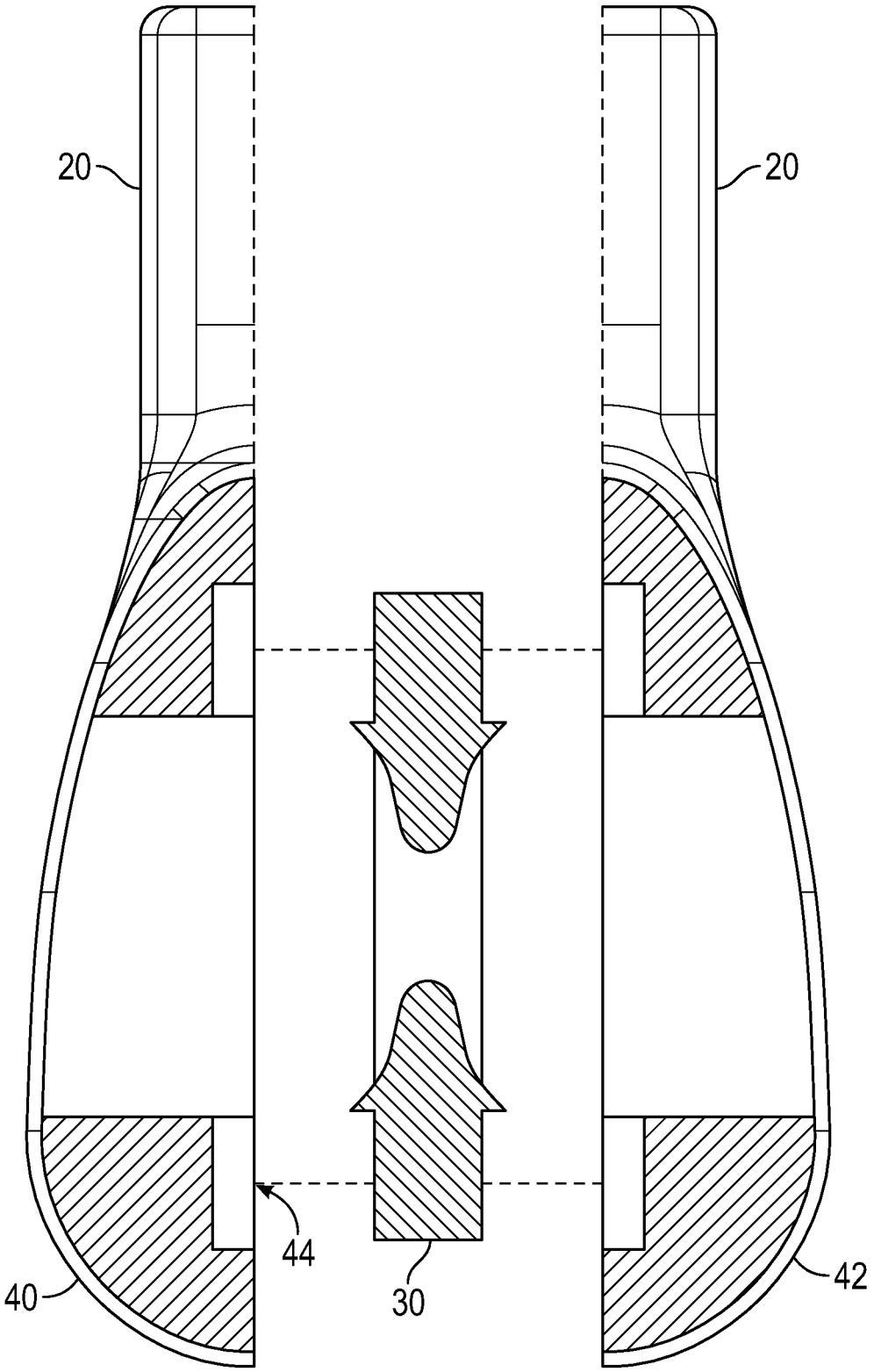
FIG. 5 is a schematic partial cross-sectional view of a cable lock, such as taken along line 3-3 in FIG. 2, formed via a snap-fit assembly.

In one embodiment, the cable-engaging features 12 may be formed from a different material than some or all of the surrounding housing 20. More specifically, the housing may be more rigid to promote easy grip and durability, while the cable engaging features 12 may be formed from a comparatively softer material that has more compliance to avoid damaging the cable 14. FIGS. 3-5 schematically illustrate three alternate manners in which such a multi material construction may be created. Each figure is intended to represent a cross-section of the lock 10 depicted in FIG. 2, taken along line 3-3. It should be appreciated that these drawings are not to scale.

As generally shown, in each design, the cable engaging features 12 may collectively be formed as a portion of an insert 30. In some embodiments, the insert 30 may have a hardness, measured on the Shore A hardness scale of between about 40 A and about 80 A, whereas the housing may have a hardness, measured on the Shore D hardness scale of between about 40 D and about 80 D. In some embodiments, the housing 20 may be even harder, such as being formed from a metal. If the housing 20 and insert 30 have drastically different hardnesses (e.g., Shore 40 A vs aluminum), an intermediate material having a hardness between that of the insert 30 and the housing 20 may be provided between the two components to act as a strain relief. In one particular configuration, this intermediate strain relief material may be provided only near the perimeter of the aperture 22 to discourage wear or tearing at the edge.

Referring to FIG. 3, in one configuration, the insert 30 and the housing 20 may be integrally formed, for example, using a co-molding process. In this process, both the housing 20 and insert 30 may be concurrently formed within the same mold by shooting two different types of polymer into the same molding cavity. Depending on the molding conditions, localized mixing may occur within a transition zone 32 between the housing 20 and the insert 30. In such a design, to facilitate the best bond between the two materials, it is preferable for the two polymers to have a common base resin or resin selected from a common class of resins.

FIG. 4 schematically illustrates an embodiment of the lock 10 formed via an insert injection molding process. In this process, the insert 30 may be initially formed, for example, via a first injection molding process and from a first material. The insert 30 may then be placed within a secondary mold where the polymer of the housing 20 is shot around a portion 34 of the first component, where it then solidifies and locks the insert in place. If an insert injection molding process is used, it may be beneficial for the overmolded portion 34 to include one or more mechanical retention features 36, such as a channel, rib, or aperture that may provide additional mechanical interlocking/attachment.

FIG. 5 schematically illustrates a third manner of construction, whereby two preformed halves 40, 42 of the housing 20 are joined together with the insert 30 sandwiched in between (i.e., in a clamshell configuration). More specifically, when the first half 40 of the housing 20 is joined to the second half 42 of the housing 20, the two may collectively define an interior volume 44 therebetween. When assembled, the insert 30 fills at least a portion of the volume 44 and is in contact (and preferably in compression between) both adjacent halves 40, 42.

In any of these three configurations, if multiple apertures 22 are included in the lock 10 (i.e., to receive multiple cables), it may be possible to use a single insert 30 that simply includes multiple openings 48, each corresponding to a different aperture 22.

Figure 6:
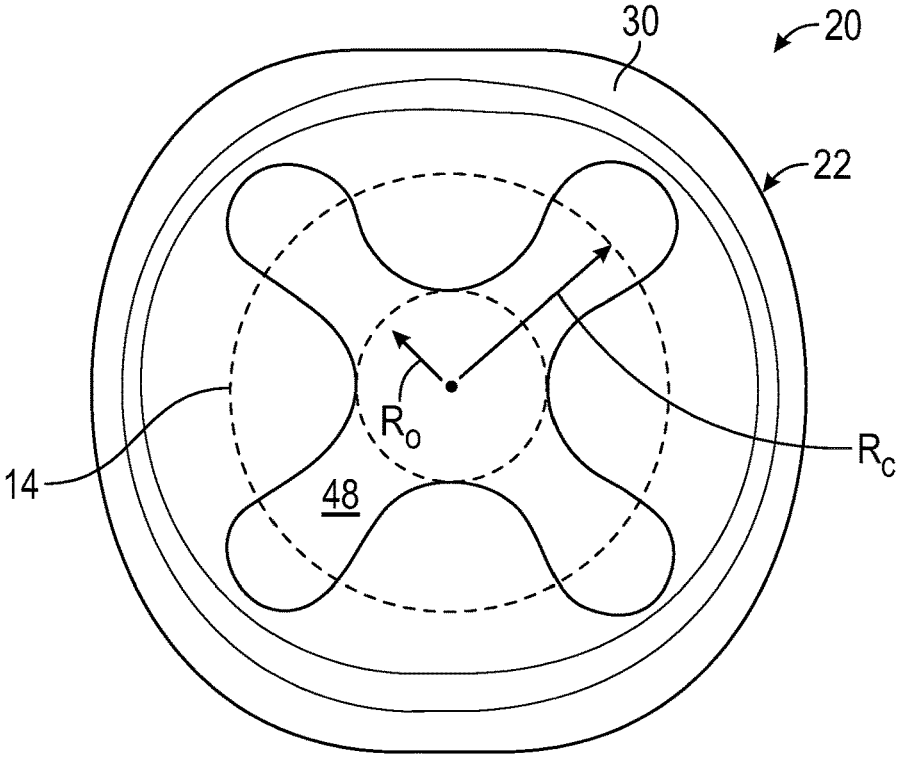
FIG. 6 is a schematic side view of an aperture of a cable lock, further illustrating an unstressed relative diameter of a cable for use with the lock.
Figure 7:
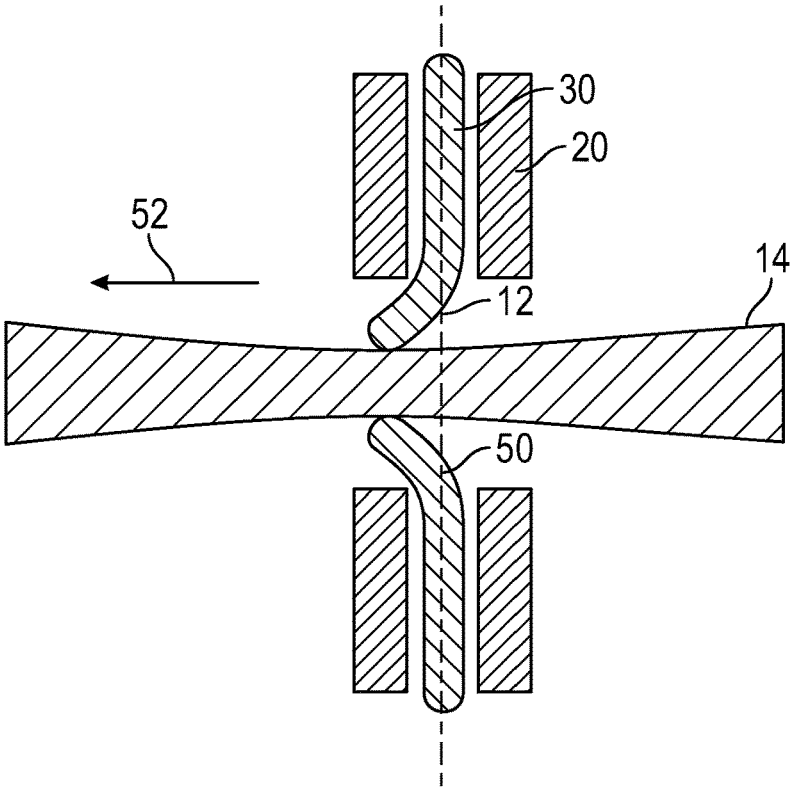
FIG. 7 is a schematic cross-sectional view of a cable being drawn through a cable lock.

As shown in FIG. 6, during use, the cable 14 may normally have an unstressed radius $R_C$ that is greater than the smallest radius Ro of the opening 48 when the cable-engaging features 12 are in an unstressed state. When the cable 14 is passed through the opening 48, such as shown in FIG. 7, it may bend/deflect one or more of the compliant cable-engaging features 12 away from a neutral plane 50 in the direction of the relative travel 52 of the cable 14. In order to reverse the direction of relative travel of the cable 14, the cable-engaging features 12 must toggle over-center to an opposite side of the neutral plain 50. Such an operation may require more force than simply continued translation in the original direction of travel 52.

In general, the present lock may be designed to apply three different resistive forces depending on the use and state of the lock 10 and cable 14. A first resistance may be the dynamic resistance that is presented when the lock 10 is sliding in a constant direction along a cable 14. This resistance may be configured to be the lowest resistance that is experienced by the lock 10.

A second resistance, which may be greater than the first, is when the lock 10 begins to slide in the same direction on the cable 14 as the prior direction of travel. This "static" resistance may be a product of greater impingement of the cable engaging features 12 into the cable 14 initially, combined with the greater static resistance of the lock 10 on the cable 14. Finally, the greatest amount of resistance that the lock may produce involves reversing the direction of prior travel from a standstill. In doing so, not only does the static friction of the lock 10 on the cable 14 need to be overcome, but the compliant, cable engaging features 12 must be elastically compressed across the neutral plane to flip to the opposite side.

Figure 8:
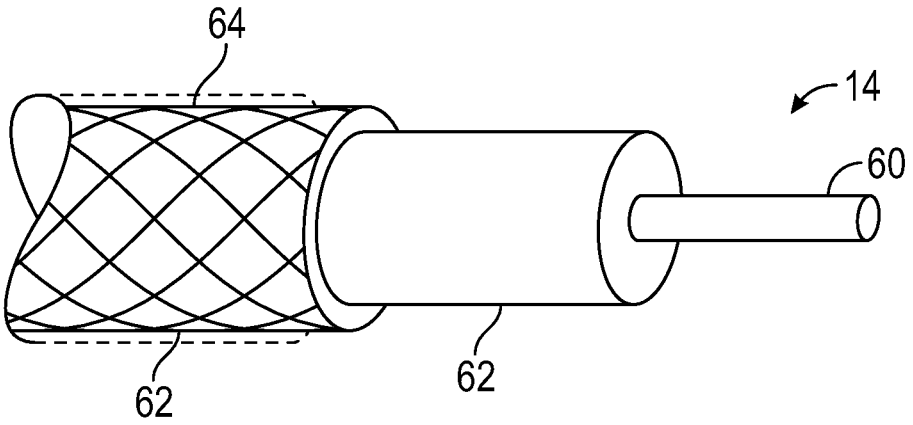
FIG. 8 is a schematic partial cut-away view of a cable that may be used with the present cable lock.

FIG. 8 schematically illustrates one embodiment of a cable 14 that may be used with the present lock 10. As shown, the cable 14 may be formed from multiple layers, each having a different material and/or construction. In this configuration, the cable 14 may include one or more core layers 60, and one or more outer layers 62 that surround the one or more core layers 60. In some embodiments, the cable 14 may further include one or more friction-promoting and/or water repelling outer coatings 64 that surround the outer layers 62. In general, the outer layers 62 may be characterized by a radial elasticity/compressibility, while the core layers 60 may be characterized by an inelasticity in an axial direction along the length of the cable.

In one configuration, the one or more core layers 60 may comprise a single core around which the outer layers 62 are wrapped. The single core may be, for example, a solid extruded polymer or bundle of stranded polymeric cables. Conversely, the one or more outer layers 62 may include, for example, a layer of polymeric foam surrounding the core, or a layer of foam surrounded by a solid skin or braided fabric.

In general, the core layers 60 may provide the cable 14 with tensile properties that make it suitable for intended lacing or drawstring applications. For example, a shoelace is expected to have a certain amount of axial rigidity such that when it is drawn tight, it does not noticeably stretch and can maintain a suitable tension across the shoe. Conversely, in the present designs, the outer layers 62 of the cable 14 are designed to be more elastic such that they may radially compress in response to the force applied by the compliant cable engaging features 12, such as shown in FIG. 7. With reference to FIG. 6, in one embodiment, the core 60 of the cable 14 may have a diameter that is approximately equal to the smallest diameter of the opening 48 (i.e., twice Ro).

Figure 9:
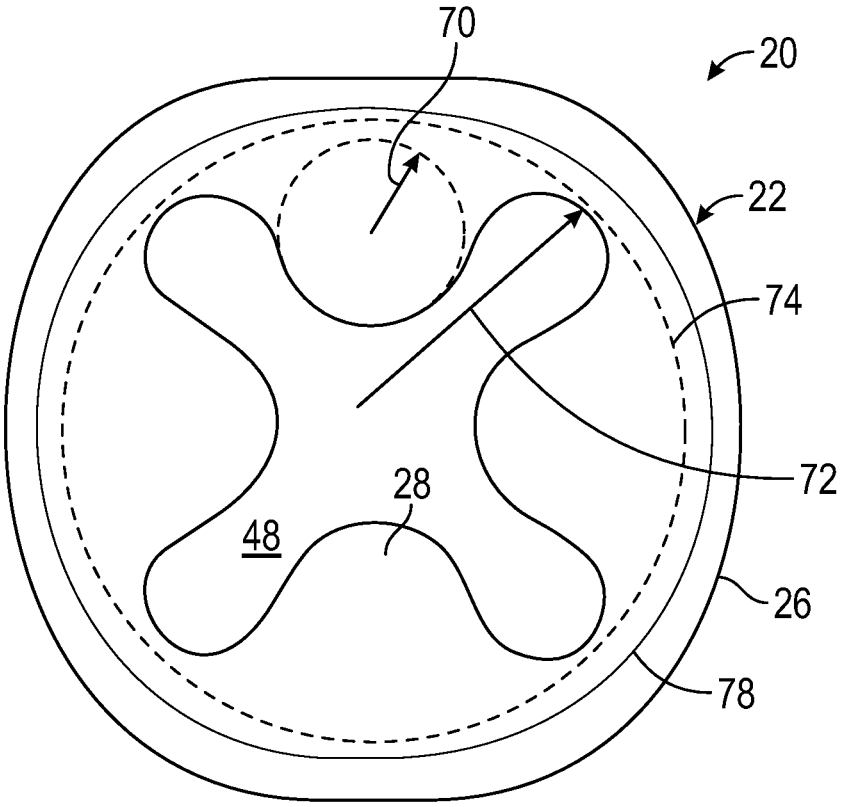
FIG. 9 is a schematic side view of an aperture of a cable lock.

FIG. 9 schematically illustrates one embodiment of an aperture 22 that may receive a cable. As shown, the aperture 22 includes plurality of discrete lobes 28 that are equally spaced around the perimeter 26 of the aperture 22 and define an opening 48 therebetween. This embodiment specifically includes four lobes 28, though as noted above, more or fewer lobes 28 may be used. In one embodiment, each lobe 28 may have a radius of curvature 70 that is between about 25% and about 40% of the radius of curvature 72 of the aperture 22 or of the smallest circle 74 drawn through the root of each lobe 28. Further, in an embodiment, each lobe may extend from this circle 74 by a distance that is also between about 25% and about 40% of the diameter of the circle 74. In one embodiment, each lobe may extend inward from this circle 74 by an amount that is about 33% of the diameter of the circle 74. It should be noted that in some embodiments, the reference circle 74 may be coincident with the aperture 22. In other embodiments, however, such as shown in FIG. 9, there may be a spacer or transition region 78 between the circle 74 and the housing 20.

Figure 10A:
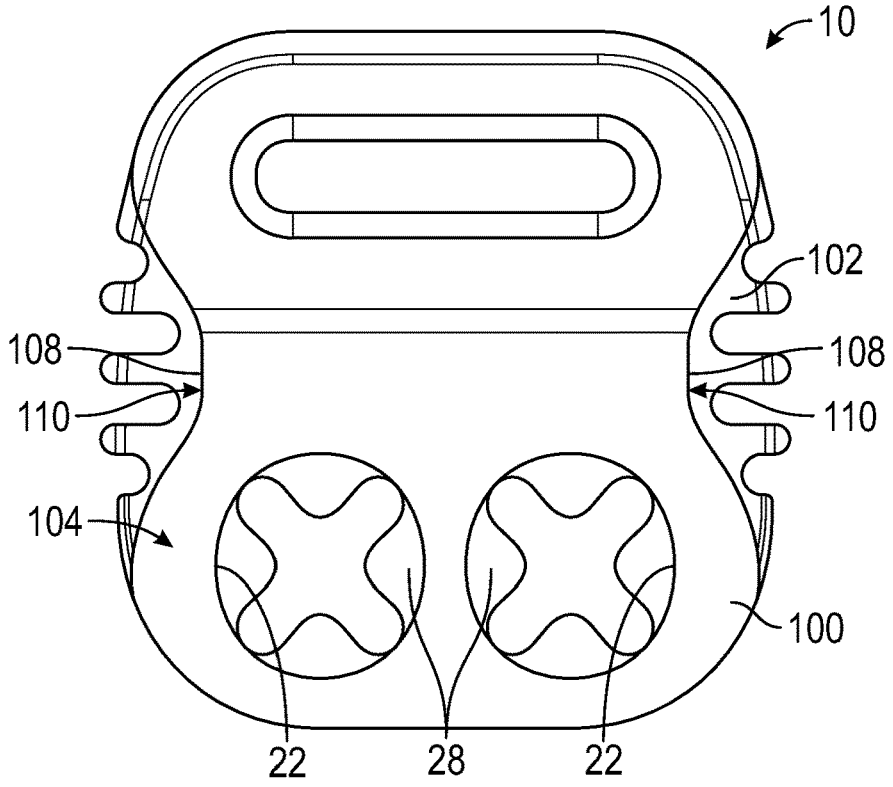
FIG. 10A is a schematic side view of an embodiment of a cable lock.
Figure 10B:
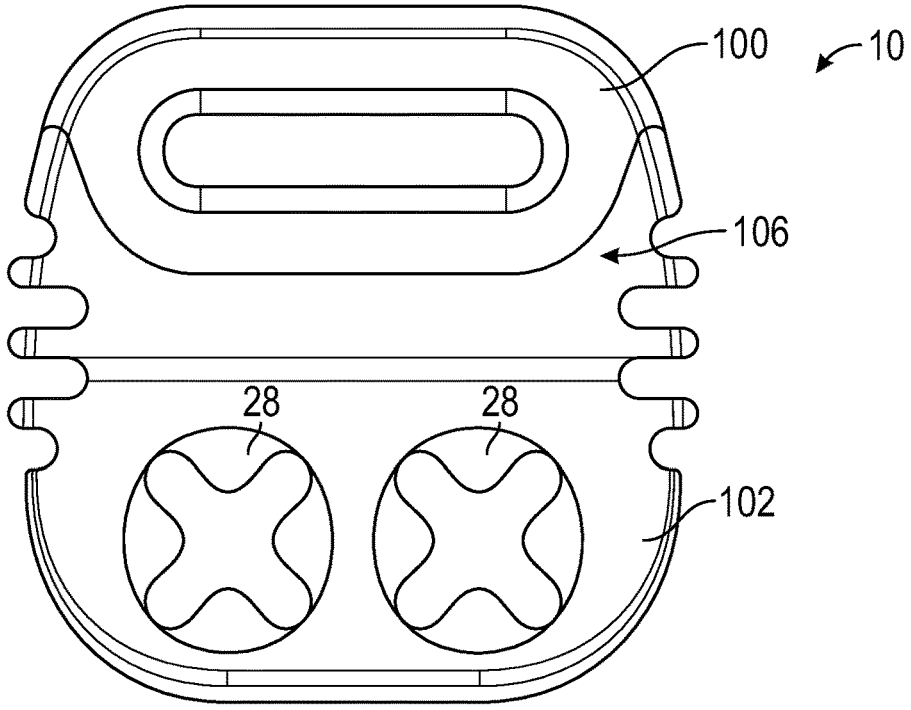
FIG. 10B is a schematic opposing side view of the cable lock of FIG. 10A.

FIGS. 10A and 10B illustrate another embodiment of a cable lock 10 that operates in a similar manner as described above. As generally illustrated, this cable lock includes two polymeric components 100, 102 that are combined or integrally formed into a single unit. In general, the first component 100 may form a structural frame of the lock 10, while the second component 102 is comparatively softer and provides the compliance necessary to enable the cable engaging features. In this configuration, the components may be layered such that the first, frame component 100 forms at least a majority of the outer surface of a first side 104 of the lock 10, while the second, compliant component 102 forms at least a majority of the outer surface of a second, opposing side 106.

When viewed from a perspective normal to the first side 104, the second component (i.e., which forms the cable engaging lobes 28) may also extend beyond a portion of opposing side edges 108 of the first component 100. In this manner, the softer second component 102 may serve a secondary function of providing a more malleable grip for a user's fingers to engage with. To provide a more streamlined silhouette, the first component may include opposing concave recesses 110 that enable the second component to extend beyond without requiring it to positively protrude in a convex manner. In general, the first, frame component 100 may provide a degree of rigidity to the lock 10.

With reference to FIG. 1, in one embodiment, the housing 20 may further define a slit 90 or hole through which a tether, tab, or string may extend. This tether may be used as an alternative to simply grabbing the lock and forcefully sliding it along the cable 14. Examples of designs that may utilize the presently described slider are described in U.S. patent application Ser. No. 17/220,486 (filed 1 Apr. 2021) and U.S. Provisional Patent Application No. 63/053,262 (filed 17 Jul. 2020), both of which are incorporated by reference in their entirety.

While the figures predominantly show circular apertures, other geometries for the apertures/openings may also be used. For example, in one embodiment, the apertures 22 may have a square or rectangular shape, or even a triangular or hexatonal shape, with compliant cable engaging features extending radially inward from a perimeter and being dimensioned to contact and at least partially impinge into a cable 14 extending therethrough.

In still another embodiment, the housing 10 may be entirely made from a softer material without resorting to the use of secondary compliant cable engaging features 12. Such a material may have a hardness measured on the Shore A Hardness Scale of between about 40 A and about 80 A, or between about 60 A and about 80 A. In one particular embodiment, the material may be a thermoplastic polyurethane having a hardness measured on the Shore A Hardness Scale of about 75 A.

Similar to the embodiments described above, this softer housing 10 design may include one or more apertures 22 extending through the thickness of the housing 10. Each aperture 22 may have an outer diameter (when in a relaxed state) that is smaller than an outer diameter of the cable 14 when the cable is in a relaxed state. In this manner, when the cable 14 extends through the aperture 22, and absent any external forces, the housing 10 may elastically impinge into and radially deform a localized portion of the cable 14. This compressive force, together with any surface friction/material interaction may resist or discourage any relative movement of the housing 10 along the cable 14.

To release the clamping force and permit the housing 10 to slide along the cable 14, a user may pull/tension a strap extending through, for example, a slit 90 or hole in the housing 10 that is located apart from the apertures 22. In some embodiments, the material construction of the lock 10 may cause the one or more apertures 22 to elastically dilate and/or elongate when the housing 10 is tensioned, such as via a strap through the slit 90. When this happens, the compressive force applied by the housing 10 against the cable 14 may be reduced to a degree where the tension applied to the pull strap may also induce a relative motion of the housing 10 along the cable 14. Said another way, when the aperture 22 dilates, the amount of compressive locking force applied by the housing 10 against the cable 14 is reduced and relative motion of the housing 10 along the cable 14 is more easily achieved.

The above features and advantages, and other features and advantages, of the present teachings are readily apparent from the following detailed description of some of the best modes and other embodiments for carrying out the present teachings, as defined in the appended claims, when taken in connection with the accompanying drawings.

The invention claimed is:

1. A cable lock adapted to temporarily maintain a static position along a cable strung through an article of footwear or apparel, the cable lock comprising:

a frame component defining an aperture, the frame component formed from a first material and the aperture extending through a thickness of the frame component; and a second component defining an opening to receive the cable, the second component formed from a second material that is softer than the first material, the second component comprising a plurality of cable engaging features extending radially inward from a perimeter of the aperture, the plurality of cable engaging features being adapted to deflect away from a neutral, unstressed plane when the cable is drawn through the opening;

wherein the second component extends outward beyond opposing side edges of the frame component to provide a grip.

2. The cable lock of claim 1, wherein the first material has a hardness of from about 40 D to about 80 D, measured on a Shore D hardness scale, and wherein the second material has a hardness of from about 40 A to about 80 A, measured on a Shore A hardness scale.

3. The cable lock of claim 1, wherein each of the plurality of cable engaging features has a radius of curvature that is between about 25% and about 40% of a radius of curvature of the aperture or of a smallest possible circle drawn through a root of each of the plurality of cable engaging features.

4. The cable lock of claim 1, wherein each of the plurality of cable engaging features extends from a smallest possible circle drawn through a root of each of the plurality of cable engaging features by a distance that is between about 25% and about 40% of a diameter of the circle.

5. The cable lock of claim 1, further comprising a cable having an outer diameter that is greater than a diameter of a circle drawn through each of the plurality of cable engaging features.

6. The cable lock of claim 5, wherein the cable comprises a core layer and an outer layer that surrounds the core layer, and wherein the core layer is less elastic than the outer layer.

7. The cable lock of claim 1, wherein the frame component and the second component are integrally connected to each other.

8. The cable lock of claim 1, wherein the aperture is a first aperture and wherein the frame component further defines a second aperture extending through a thickness of the frame component; and wherein the second component extends across both the first aperture and the second aperture, the second component defining a second opening within the second aperture and a second plurality of cable engaging features extending radially inward from a perimeter of the second aperture, the second plurality of cable engaging features being adapted to deflect away from the neutral, unstressed plane when a second cable is drawn through the second opening.

9. The cable lock of claim 1, wherein the frame component further defines an opening adapted to receive a pull strap.

10. A cable lock for securing opposing first and second end portions of a cable threaded through portions of an article of footwear or apparel, the cable lock comprising:

a frame component defining a first aperture and a second aperture, each of the first and second apertures extending entirely through a thickness of the frame component, the frame component being formed from a first polymeric material; and a compliant second component formed from a second polymeric material and extending across each of the first aperture and the second aperture, the compliant second component defining a first opening extending through the compliant second component and aligned with the first aperture and further defining a second opening extending through the compliant second component and aligned with the second aperture, the first opening adapted to receive the first end portion of the cable and the second opening adapted to receive the second end portion of the cable;

wherein the compliant second component forms a first plurality of cable engaging features extending radially inward from the first opening such that each of the cable engaging features of the first plurality of cable engaging features is operative to contact and impress into the first end portion of the cable;

wherein the compliant second component further forms a second plurality of cable engaging features extending radially inward into the second opening such that each of the cable engaging features of the second plurality of cable engaging features is operative to contact and impress into the second end portion of the cable; and wherein the compliant second component further extends outward beyond opposing side edges of the frame component to define a grip.

11. The cable lock of claim 10, wherein each of the cable engaging features of the first plurality of cable engaging features is adapted to deflect away from a neutral, unstressed plane when the first end portion of the cable is drawn through the first opening; and wherein each of the cable engaging features of the second plurality of cable engaging features is adapted to deflect away from a neutral, unstressed plane when the second end portion of the cable is drawn through the second opening.

12. The cable lock of claim 10, wherein the first material has a hardness of from about 40 D to about 80 D, measured on a Shore D hardness scale, and wherein the second material has a hardness of from about 40 A to about 80 A, measured on a Shore A hardness scale.

13. The cable lock of claim 10, wherein each of the cable engaging features of the first and second plurality of cable engaging features has a radius of curvature that is between about 25% and about 40% of a radius of curvature of a smallest possible circle drawn through a root of each of the respective plurality of cable engaging features.

14. The cable lock of claim 10, wherein each of the cable engaging features of the first and second plurality of cable engaging features extends from a smallest possible circle drawn through a root of each of the respective plurality of cable engaging features by a distance that is between about 25% and about 40% of a diameter of the circle.

15. The cable lock of claim 10, further comprising a cable having the first and second end portions, the cable having an outer diameter that is greater than a diameter of a circle drawn through a tip of each of the plurality of cable engaging features.

16. The cable lock of claim 15, wherein the cable comprises a core layer and an outer layer that surrounds the core layer, and wherein the core layer is less elastic than the outer layer.

17. The cable lock of claim 10, wherein the frame component and the compliant second component are integrally connected to each other.

18. The cable lock of claim 10, wherein the frame component further defines an opening adapted to receive a pull strap.

19. A cable lock adapted to temporarily maintain a static position along a cable strung through an article of footwear or apparel, the cable lock comprising:

a housing defining an aperture, the housing formed from a first material and the aperture extending through a thickness of the housing; and an insert provided at least partially within the aperture and defining an opening to receive the cable, the insert formed from a second material that is softer than the first material, the insert comprising a plurality of cable engaging features extending radially inward from a perimeter of the aperture, the plurality of cable engaging features being adapted to deflect away from a neutral, unstressed plane when the cable is drawn through the opening;

wherein the insert includes a portion extending into the housing around the aperture; and wherein the portion of the insert includes a mechanical retention feature that mechanically interlocks with the housing.

20. The cable lock of claim 19, wherein the mechanical retention feature is one of a channel, a rib, or an aperture.

* * * * *